US012503928B2

(12) United States Patent
Craker et al.

(10) Patent No.: US 12,503,928 B2
(45) Date of Patent: Dec. 23, 2025

(54) SELF CLEANING FRACKING PLUG AND METHOD

(71) Applicant: Workover Solutions, Inc., Imperial, PA (US)

(72) Inventors: Kyle Craker, Quaker City, OH (US); Logen Kanngiesser, Wheeling, WV (US)

(73) Assignee: Workover Solutions, Inc., Imperial, PA (US)

( * ) Notice: Subject to any disclaimer, the term of this patent is extended or adjusted under 35 U.S.C. 154(b) by 744 days.

(21) Appl. No.: 17/374,230

(22) Filed: Jul. 13, 2021

(65) Prior Publication Data

US 2022/0018208 A1 Jan. 20, 2022

Related U.S. Application Data

(60) Provisional application No. 63/051,840, filed on Jul. 14, 2020.

(51) Int. Cl.
*E21B 33/12* (2006.01)
*E21B 29/00* (2006.01)
*E21B 43/26* (2006.01)

(52) U.S. Cl.
CPC ..... *E21B 33/1208* (2013.01); *E21B 29/002* (2013.01); *E21B 43/26* (2013.01)

(58) Field of Classification Search
CPC ..... E21B 33/1208; E21B 29/002; E21B 43/26
USPC ..... 166/308.1
See application file for complete search history.

(56) References Cited

U.S. PATENT DOCUMENTS

2005/0205264 A1* 9/2005 Starr ..... E21B 33/134 166/243
2010/0132960 A1* 6/2010 Shkurti ..... E21B 33/134 166/134
2013/0299192 A1* 11/2013 Xu ..... E21B 23/01 166/241.6
2018/0252067 A1* 9/2018 Fripp ..... E21B 33/1208
2019/0264520 A1* 8/2019 Frazier ..... E21B 33/134

* cited by examiner

*Primary Examiner* — Tara Schimpf
*Assistant Examiner* — Patrick F Lambe
(74) *Attorney, Agent, or Firm* — Jones Walker LLP

(57) ABSTRACT

A plug used in the hydraulic fracking of hydrocarbon wells. The plug, known as a frac or bridge plug, contains one or more containers housing a chemical substance such as a solid, liquid, or gel composition. The composition may constitute or include a cleaning agent, friction reducer, suspending agent, or other wellbore additive. For example, the composition may constitute or include epoxy components, resins, thermoplastics, dry add friction reducers, dry add gel, dry add pipe on pipe, similar agents, or any combination thereof. The containers can include the same chemical substance or a variety of chemical substances. During drill out of the plug, the containers rupture and release the chemical substance into the wellbore. The released chemical substance, if a cleaning agent, assists in the cleaning of the milled-plug pieces from the wellbore.

19 Claims, 6 Drawing Sheets

SELF CLEANING FRACKING PLUG AND METHOD

CROSS-REFERENCE TO RELATED APPLICATIONS

This application claims the benefit of and priority to U.S. Provisional Patent Application No. 63/051,840, filed on Jul. 14, 2020, which is incorporated by reference herein.

FIELD OF THE DISCLOSURE

This disclosure relates to plugs for use during hydraulic fracturing, or "fracking." More specifically, the disclosure relates to a bridge or frac plug containing one or more chemical substances such as a solid, liquid, or gel cleaning agent, friction reducer, suspending agent, and/or other wellbore additive. The chemical substance is released when the plug is drilled for removal.

BACKGROUND OF THE DISCLOSURE

Hydraulic fracturing, which is more commonly known as "fracking," is a process of fracturing rock using a pressurized liquid. Fracking fluid is composed primarily of water, sand, and/or other suspended proppants as well as a thickening agent, all of which are well-known to those skilled in the art. The fracking fluid is injected at high pressure into a wellbore to create cracks in deep rock formations. Natural gas and oil can then flow more freely through the cracked rock. When pressure is removed, the sand or other proppants hold the fractures open.

When a portion of a well is being fracked, that section of the well is isolated using a plug. The plug is lowered into the well using a wireline, and/or pushed through horizontal sections of the well by creating fluid pressure using a pump. Once the plug is in a predetermined position, slip rings that surround the plug are moved using either a tool or an explosive powder charge so that they slide onto a cone-shaped section of the plug. Moving these slip rings onto the cone-shaped plug section expands the slip rings against the wall of the well casing and holds the plug in position. The sealing element is compressed during the setting process and forms a seal between the well casing and plug. A ball is dropped from the surface and thereafter pumped down to land on the plug to isolate the well into two sections. With the plug in position, the well casing is perforated, and the fracking fluid is injected into the well.

Once fracking in one section of the well is complete, the plug is removed by drilling through the plug, breaking the plug into smaller pieces. These pieces are then removed from the well by pumping drilling mud into the well and by injecting wellbore cleaning chemicals and other substances or additives into the well. These cleaning chemicals, substances, and/or additives are known to those skilled in the art, and may include, for example, epoxy components, resins, thermoplastics, dry add friction reducers, dry add gel, dry add pipe on pipe, or combinations thereof.

Eliminating the step of adding the cleaning chemicals would speed the fracking process, as well as reducing the cost of this process.

SUMMARY OF THE DISCLOSURE

The present disclosure relates to an embodiment of a frac plug that may include a mandrel having an upper end, a lower end, and an outer surface. The frac plug may also include a sealing member operatively positioned about the outer surface of the mandrel. The sealing member may have an upper end and a lower end. The frac plug may also include a cone operatively positioned about the outer surface of the mandrel. The cone may have a first end and a second end. The first end of the cone may have an outer diameter greater than an outer diameter of the second end. The first end of the cone may abut either the upper or lower end of the sealing member. The frac plug may also include a slip ring operatively positioned about the outer surface of the mandrel. The slip ring may have a first end and a second end. The first end of the slip ring may be positioned adjacent to the second end of the cone. The frac plug may also include a first container operatively positioned about the outer surface of the mandrel. The container may have an interior configured to contain a chemical substance.

In another embodiment, the frac plug may include a second container operatively positioned about the outer surface of the mandrel. The second container may have an interior configured to contain the chemical substance.

In yet another embodiment of the frac plug, the first container may be situated adjacent to the second container.

In yet another embodiment, the frac plug may include a third container operatively positioned about the outer surface of the mandrel. The third container may have an interior configured to contain the chemical substance.

In yet another embodiment of the frac plug, the second container may be situated adjacent to the third container.

In yet another embodiment of the frac plug, the interior of the first container may contain the chemical substance. The chemical substance may be a solid, liquid, or gel composition. The composition may be a well cleaning agent, friction reducer, suspending agent, or wellbore additive. The composition may be selected from the group consisting of epoxy components, resins, thermoplastics, dry add friction reducers, dry add gel, dry add pipe on pipe, and any combination thereof.

The present disclosure also relates to a further embodiment of a frac plug that may include a mandrel having an upper end, a lower end, and an outer surface. The frac plug may include a sealing member operatively positioned about the outer surface of the mandrel. The sealing member may have an upper end and a lower end. The frac plug may include a first cone operatively positioned about the outer surface of the mandrel. The first cone may have a first end and a second end. The first end of the first cone may have an outer diameter greater than an outer diameter of the second end. The first end of the first cone may abut the upper end of the sealing member. The frac plug may include a second cone operatively positioned about the outer surface of the mandrel. The second cone may have a first end and a second end. The first end of the second cone may have an outer diameter greater than an outer diameter of the second end of the second cone. The first end of the second cone may abut the lower end of the sealing member. The frac plug may include a first slip ring operatively positioned about the outer surface of the mandrel. The first slip ring may have a first end and a second end. The first end of the first slip ring may be positioned adjacent to the second end of the first cone. The frac plug may include a second slip ring operatively positioned about the outer surface of the mandrel. The second slip ring may have a first end and a second end. The first end of the second slip ring may be positioned adjacent to the second end of the second cone. The frac plug may include one or more containers operatively positioned about the outer surface of the mandrel. Each of the one or more containers may have an interior configured to contain a chemical substance.

In another embodiment of the frac plug, the one or more containers may comprise a first container and a second container.

In yet another embodiment of the frac plug, the first container may be situated adjacent to the second container.

In another embodiment of the frac plug, the one or more containers may comprise a first container, a second container, and a third container.

In yet another embodiment of the frac plug, the first container may be situated adjacent to the second container and the second container may be situated adjacent to the third container.

In yet another embodiment of the frac plug, the interior of each of the one or more containers may contain the chemical substance. The chemical substance may be a solid, liquid, or gel composition. The composition may be a well cleaning agent, friction reducer, suspending agent, or wellbore additive. The composition may be selected from the group consisting of epoxy components, resins, thermoplastics, dry add friction reducers, dry add gel, dry add pipe on pipe, and any combination thereof.

The present disclosure also relates to a method of setting and removing a frac plug from a hydrocarbon well. The method may include the step of lowering a frac plug as described hereinabove in a wellbore to a selected location. The interior of the container of the frac plug may include a chemical substance. The method may include the step of moving the sealing ring over the cone to displace the sealing ring in an outward direction to make contact with a wall of the well. The method may include the step of perforating the wall of the well and a surrounding formation. The method may include the step of injecting fracking fluid into the wellbore to fracture the perforated formation. The method may include the step of milling the frac plug to cause a breakup of the frac plug into small pieces, a rupture of the container, and a release of the chemical substance from the interior of the container into the wellbore.

In another embodiment, the frac plug may include a second container containing the chemical substance as described hereinabove and the milling step may include the step of causing a rupture of the second container and a release of the chemical substance from the interior of the second container into the wellbore.

In another embodiment, the frac plug may include a third container containing the chemical substance as described hereinabove and the milling step may include the step of causing a rupture of the third container and a release of the chemical substance from the interior of the third container into the wellbore.

In another embodiment, the chemical substance contained within the container(s) of the frac plug and released into the wellbore may be a solid, liquid, or gel composition. The composition may be a well cleaning agent, friction reducer, suspending agent, or wellbore additive. The composition may be selected from the group consisting of epoxy components, resins, thermoplastics, dry add friction reducers, dry add gel, dry add pipe on pipe, and any combination thereof.

BRIEF DESCRIPTION OF THE DRAWINGS

Like reference characters denote like elements throughout the drawings.

DETAILED DESCRIPTION OF THE DISCLOSURE

Figure 1:
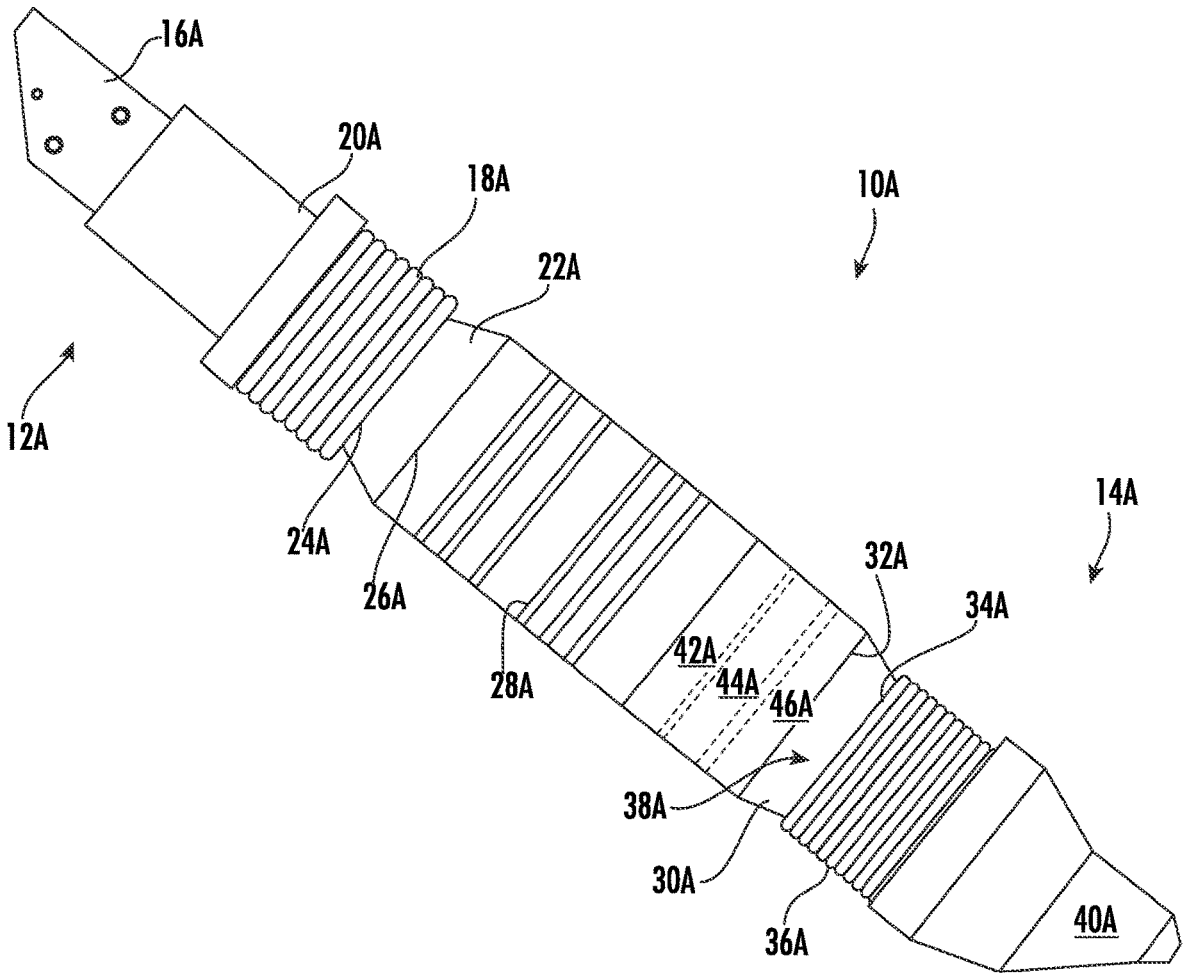
FIG. 1 is a side elevational view of a fracking plug.
Figure 2:
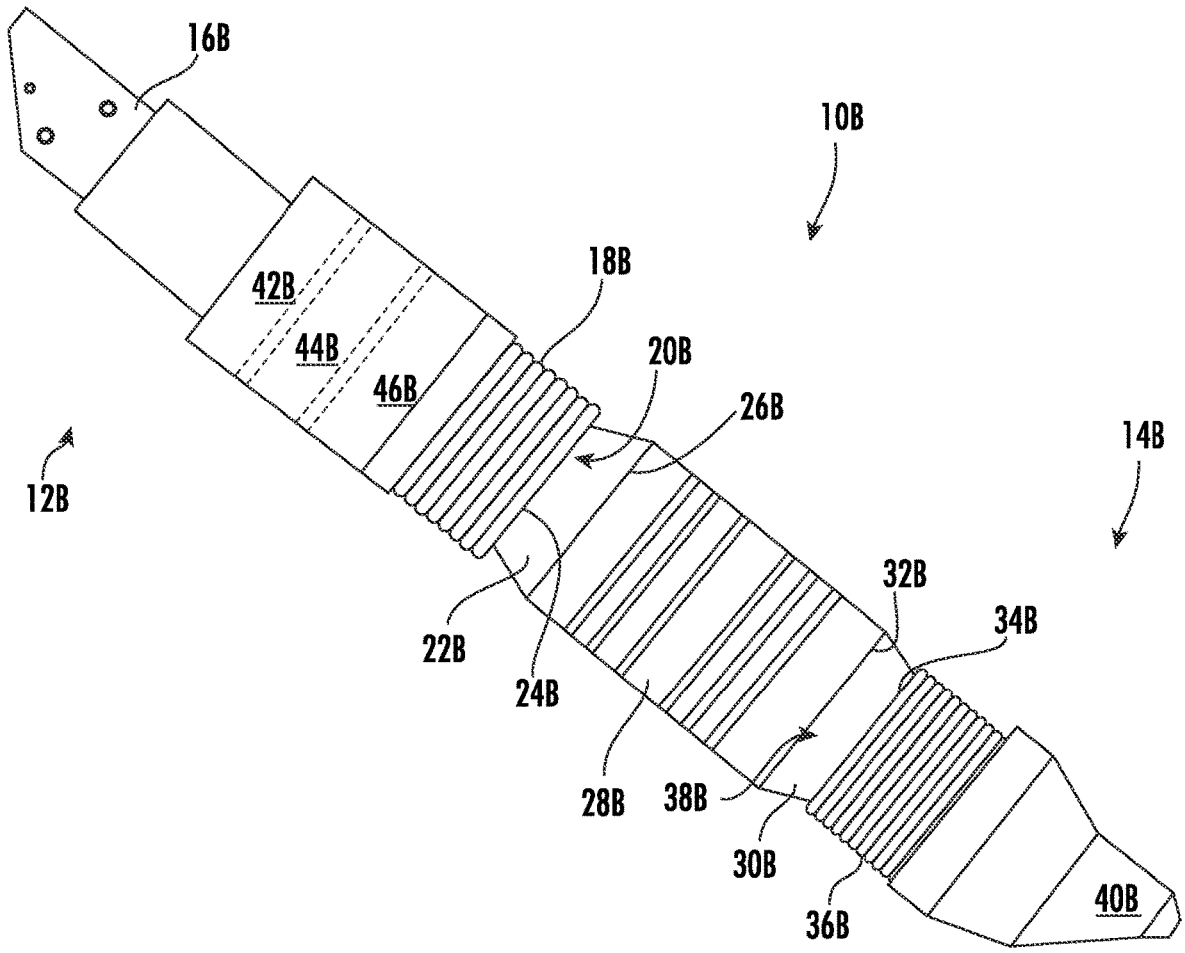
FIG. 2 is a side elevational view of an alternative fracking plug.

Referring to the drawings, two alternative fracking plugs 10A, 10B are illustrated. As used herein, a reference character by itself can refer to either fracking plug 10 of FIG. 1 or fracking plug 10B of FIG. 2. A reference character followed by the letter "A" refers to the fracking plug 10A of FIG. 1. A reference character followed by the letter "B" refers to the fracking plug 10B of FIG. 2.

Each of the fracking plugs 10A, 10B includes an upper end 12A, 12B, and a lower end 14A, 14B. The upper end 12A, 12B includes an adapter 16A, 16B that is structured to be connected to a wireline or other downhole tool in a manner that is well known to those skilled in the art of fracking. Preceding downward along the fracking plugs 10A, 10B, an upper slip ring 18A, 18B surrounds the body portion or mandrel 20A, 20B of the plug 10A, 10B. A cone 22A, 22B is disposed immediately downward of each of the slip rings 18A, 18B. The small diameter end 24A, 24B has a diameter that is substantially equal to the inner diameter of the slip rings 18A, 18B. The large diameter end 26A, 26B of each cone 22A, 22B is substantially equal to a desired expanded diameter of each of the slip rings 18A, 18B as described in greater detail below. Each of the cones 22A, 22B is connected at its larger diameter end 26A, 26B to a sealing element 28A, 28B. A lower slip ring 36A, 36B is disposed around the body portion or mandrel 38A, 38B of the plugs 10A, 10B. A lower cone 30A, 30B is disposed immediately above each of lower slip rings 36A, 36B. The small diameter end 34A, 34B of cone 30A, 30B has a diameter that is substantially equal to the inner diameter of lower slip rings 36A, 36B. The large diameter end 32A, 32B of each lower cone 30A, 30B is substantially equal to a desired expanded diameter of each of the lower slip rings 36A, 36B as described in greater detail below. Each of lower cones 30A, 30B is connected at its larger diameter end 32A, 32B to the sealing element 28A, 22B. A mule shoe 40A, 40B forms the lower end 14A, 14B of each plug 10A, 10B. The above-described elements of each plug 10A, 10B are well-known to those skilled in the art of fracking. Each of the plugs 10A, 10B includes the novel improvements described below.

Each of the plugs 10A, 10B includes at least one chemical housing. In the illustrated example of the plug 10A includes three chemical housings 42A, 44A, 46A disposed between the sealing element 28A and the cone 30A. The illustrated example of the plug 20B includes three chemical housings 42B, 44B, 46B disposed between the adapter 16B and sealing ring 18B. Other examples of fracking plugs may include chemical housings disposed at other locations within the plug. As few as one chemical housing may be included, or a number of chemical housings greater than three may be utilized.

The chemical housings 42, 44, 46 each include one or more chemical substances in solid, liquid or gel form such as well cleaning chemicals and/or other wellbore additives that are intended to enter the well upon being ruptured by a drill. These chemical substances are known to those skilled in the art, and may include, for example, epoxy components, resins, thermoplastics, dry add friction reducers, dry add gel, dry add pipe on pipe, or combinations thereof. Each of the specific cleaning chemicals and/or other additives selected may be placed in any of the housings 42, 44, 46 with the specific selection of chemicals and/or other additives and housings within which the chemicals are contained being variable depending upon the specific requirements of a specific fracking operation.

Figure 4:
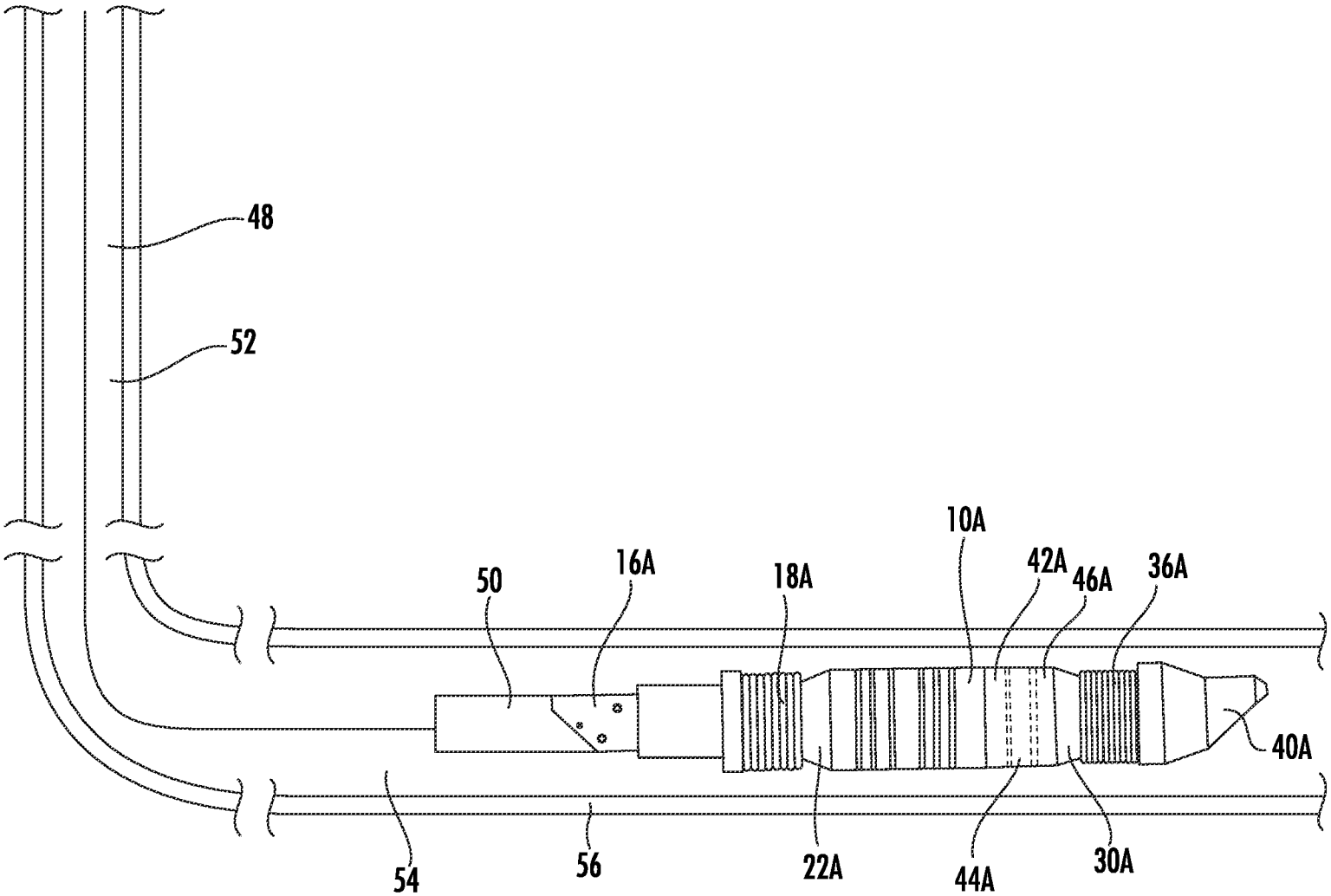
FIG. 4 is a side elevational view of the fracking plug of FIG. 1 being positioned within a well.

Use of the plug 10A, 10B is identical, and is therefore illustrated only with respect to the plug 10A. As shown in FIG. 4, the plug 10A is lowered into a well 48 using a wireline tool 50 secured to the adapter 16A. The plug 10A may be lowered through a vertical pipe section 52 by gravity, by a downhole tractor, or by pumping fluid behind the plug 10A. The plug 10A may be moved through horizontal pipe sections 54 by a downhole tractor or by pumping fluid behind the plug 10A.

Figure 3:
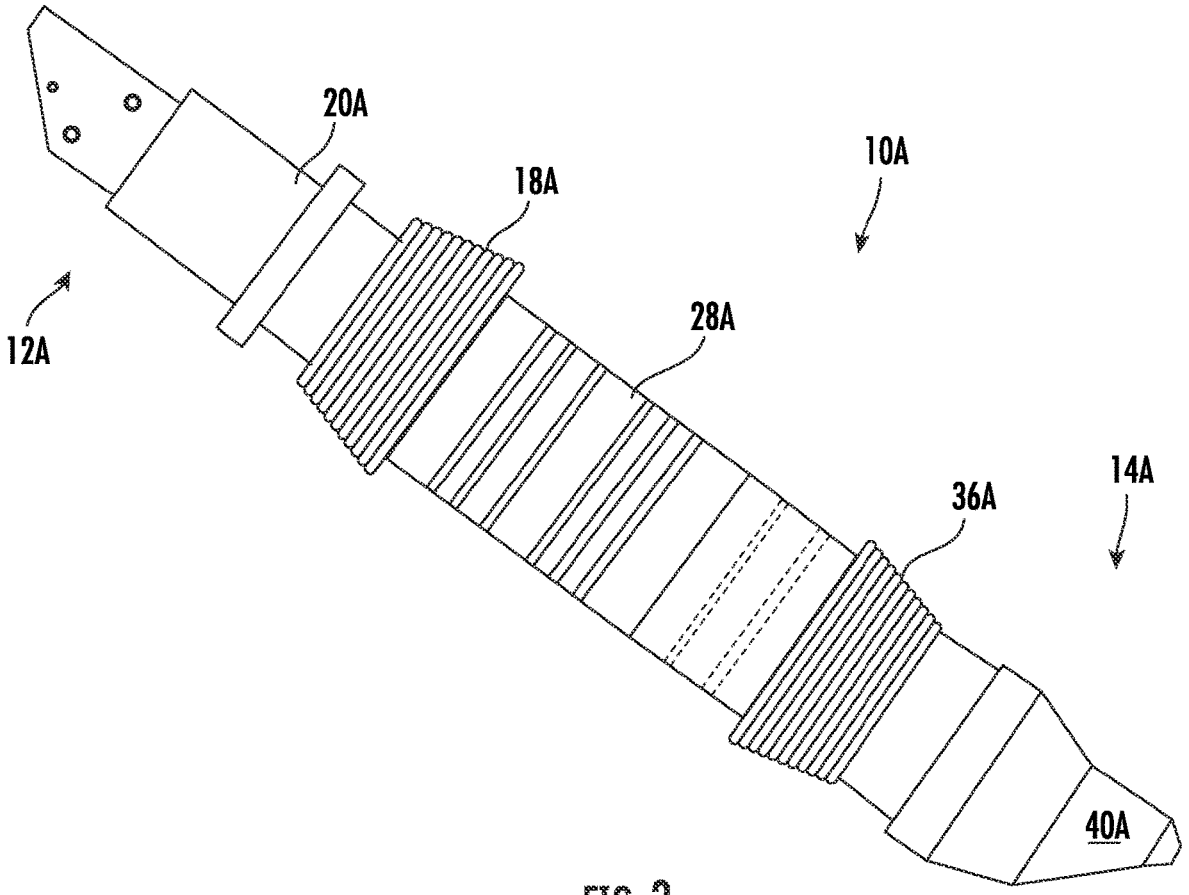
FIG. 3 is a side elevational view of the fracking plug of FIG. 1 after the slip rings have been moved into place to secure the fracking plug within a well.
Figure 5:
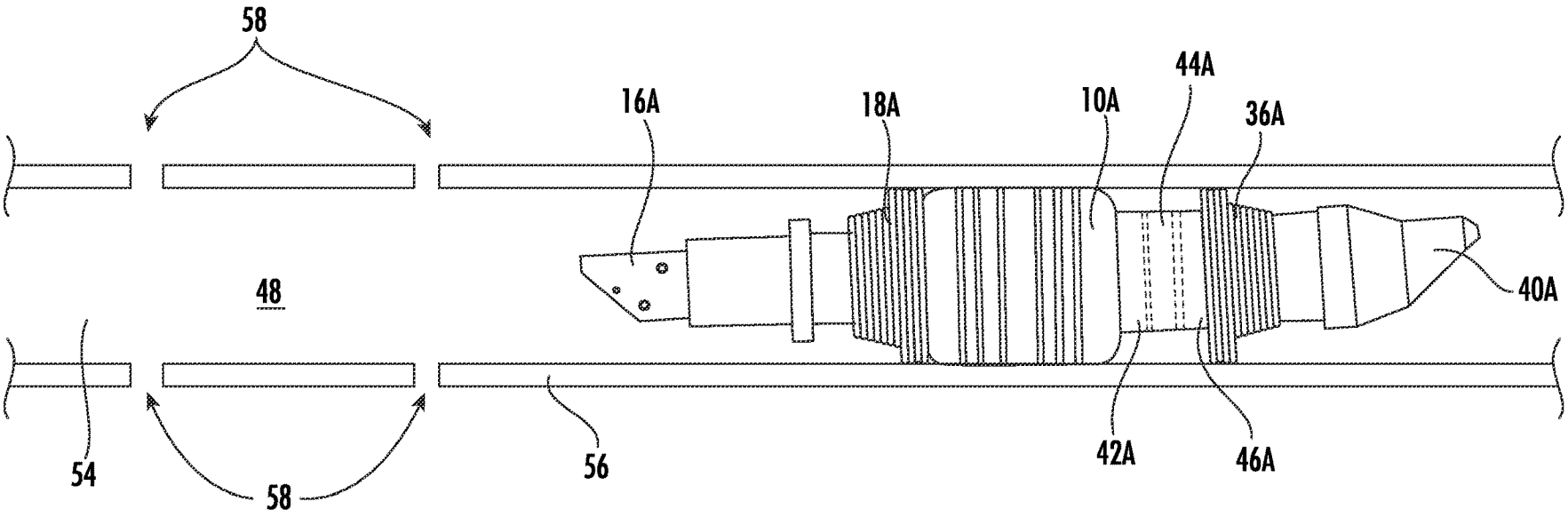
FIG. 5 is a side elevational view of the fracking plug of FIG. 1 secured within a well during a fracking operation.

Referring to FIGS. 3 and 5, once the plug 10A is positioned, the slip rings 18A, 36A are moved over the cones 22A, 30A, thus forcing the slip rings 18A, 36A outward until they contact the wall or casing 56 of the well 48, sealing against the wall or casing 56. Movement of the slip rings 18A, 36A can be accomplished using a powdered ignitable or detonatable charge inside the setting tool 50, or in other examples can be accomplished by mechanically pushing the slip rings 18A, 36A into position. Systems and methods of moving the slip rings 18A, 36A onto the cones 22A, 30A are well-known to those skilled in the art of fracking. Once the plug 10A is sealed in position, the tool 50 can be retracted, and the wall or casing 56 can be perforated, forming perforations 58 in the surrounding formation in a manner well-known to those skilled in the art. Fracking fluid can then be injected into the well 48, where it will enter the perforations 58 under pressure, fracturing the rock formations around the well 48.

Figure 6:
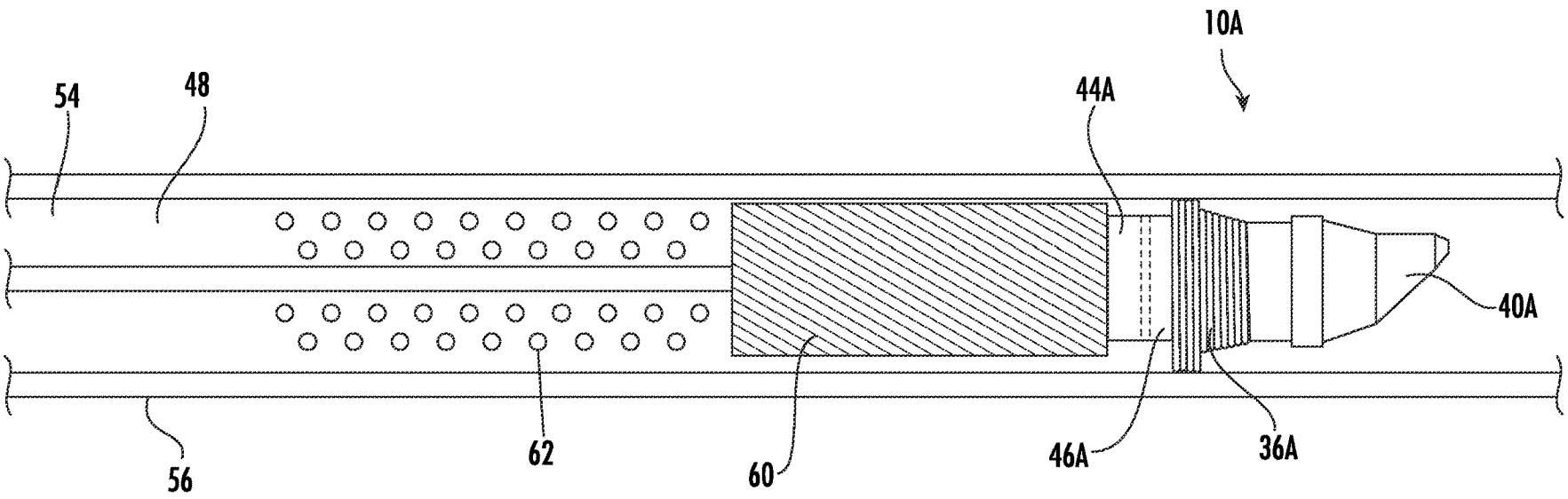
FIG. 6 is a side elevational view of the fracking plug of FIG. 1 being drilled out of a well.

Referring to FIG. 6, once fracking in a given section of the well is complete, the plug 10A is removed by drilling or milling the plug 10A using the drill or milling tool 60 to break it up into small pieces 62 which can then be flushed from the well 48. To aid in the process of cleaning the well 48 and keeping the small pieces in suspension, as the drill or milling tool 60 ruptures the chemical housings 42A, 44A, 46A, the well cleaning chemicals and/or other additives contained therein will be released into the interior 54 of the well 48, where they can assist with flushing the small pieces 62 out of the well 48. Since the cleaning chemicals are now already present within the well 48, the step of injecting these chemicals is no longer a separate step.

The present invention therefore provides a fracking plug having one or more chemical housings that hold cleaning chemicals which are released into the well when the plug is drilled for removal. Because the process of drilling the plug also releases the cleaning chemicals into the well, the process of removing the plug and cleaning the well is simplified.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A frac plug comprising:

a mandrel having an upper end, a lower end, and an outer surface;

a sealing member operatively positioned about the outer surface of the mandrel, the sealing member having an upper end and a lower end;

a cone operatively positioned about the outer surface of the mandrel, the cone having a first end and a second end, the first end of the cone having an outer diameter greater than an outer diameter of the second end, the first end of the cone abutting either the upper or lower end of the sealing member;

a slip ring operatively positioned about the outer surface of the mandrel, the slip ring having a first end and a second end, the first end of the slip ring positioned adjacent to the second end of the cone; and a first container operatively positioned about the outer surface of the mandrel, the container having an interior containing a first chemical substance, the first chemical substance comprising a well cleaning agent for maintaining small pieces of the frac plug in suspension and assisting with flushing of the small pieces from a hydrocarbon well after drilling or milling of the frac plug into the small pieces.

2. The frac plug of claim 1, further comprising a second container operatively positioned about the outer surface of the mandrel, the second container having an interior containing a second chemical substance.

3. The frac plug of claim 2, wherein the first container is situated adjacent to the second container.

4. The frac plug of claim 3, further comprising a third container operatively positioned about the outer surface of the mandrel, the third container having an interior containing a third chemical substance.

5. The frac plug of claim 4, wherein the second container is situated adjacent to the third container.

6. The frac plug of claim 1, wherein the first, second or third chemical substances each comprises a solid, liquid, or gel composition.

7. The frac plug of claim 6, wherein the composition is selected from the group consisting of epoxy components, resins, thermoplastics, dry add friction reducers, dry add gel, dry add pipe on pipe, and any combination thereof.

8. A frac plug comprising:

a mandrel having an upper end, a lower end, and an outer surface;

a sealing member operatively positioned about the outer surface of the mandrel, the sealing member having an upper end and a lower end;

a first cone operatively positioned about the outer surface of the mandrel, the first cone having a first end and a second end, the first end of the first cone having an outer diameter greater than an outer diameter of the second end, the first end of the first cone abutting the upper end of the sealing member;

a second cone operatively positioned about the outer surface of the mandrel, the second cone having a first end and a second end, the first end of the second cone having an outer diameter greater than an outer diameter of the second end of the second cone, the first end of the second cone abutting the lower end of the sealing member;

a first slip ring operatively positioned about the outer surface of the mandrel, the first slip ring having a first end and a second end, the first end of the first slip ring positioned adjacent to the second end of the first cone;

a second slip ring operatively positioned about the outer surface of the mandrel, the second slip ring having a first end and a second end, the first end of the second slip ring positioned adjacent to the second end of the second cone; and one or more containers operatively positioned about the outer surface of the mandrel, each of the one or more containers having an interior containing a chemical substance, wherein the chemical substance contained within the interior of at least one of the containers comprises a well cleaning agent for maintaining small pieces of the frac plug in suspension and assisting with flushing of the small pieces from a hydrocarbon well after drilling or milling of the frac plug into the small pieces.

9. The frac plug of claim 8, wherein the one or more containers comprise a first container and a second container.

10. The frac plug of claim 9, wherein the first container is situated adjacent to the second container.

11. The frac plug of claim 8, wherein the one or more containers comprises a first container, a second container, and a third container.

12. The frac plug of claim 11, wherein the first container is situated adjacent to the second container and the second container is situated adjacent to the third container.

13. The frac plug of claim 8, wherein the chemical substance comprises a solid, liquid, or gel composition.

14. The frac plug of claim 13, wherein the composition is selected from the group consisting of epoxy components, resins, thermoplastics, dry add friction reducers, dry add gel, dry add pipe on pipe, and any combination thereof.

15. A method of setting and removing a frac plug from a hydrocarbon well comprising the steps of:

a) lowering a frac plug in a wellbore to a selected location, the frac plug comprising: a mandrel having an upper end, a lower end, and an outer surface; a sealing member operatively positioned about the outer surface of the mandrel, the sealing member having an upper end and a lower end; a cone operatively positioned about the outer surface of the mandrel, the cone having a first end and a second end, the first end of the cone having an outer diameter greater than an outer diameter of the second end, the first end of the cone abutting either the upper or lower end of the sealing member; a slip ring operatively positioned about the outer surface of the mandrel, the slip ring having a first end and a second end, the first end of the slip ring positioned adjacent to the second end of the cone; and a first container operatively positioned about the outer surface of the mandrel, the container having an interior containing a chemical substance comprising a well cleaning agent for maintaining small pieces of the frac plug in suspension and assisting with flushing of the small pieces from the hydrocarbon well after drilling or milling of the frac plug into the small pieces;

b) moving the slip ring over the cone to displace the slip ring in an outward direction to make contact with a wall of the well;

c) perforating the wall of the well and a surrounding formation;

d) injecting fracking fluid into the wellbore to fracture the perforated formation; and e) milling the frac plug to cause a breakup of the frac plug into small pieces, a rupture of the container, and a release of the chemical substance from the interior of the container into the wellbore.

16. The method of claim 15, wherein the chemical substance comprises a solid, liquid, or gel composition.

17. The method of claim 16, wherein the composition is selected from the group consisting of epoxy components, resins, thermoplastics, dry add friction reducers, dry add gel, dry add pipe on pipe, and any combination thereof.

18. The method of claim 15, wherein the frac plug further comprises a second container operatively positioned about the outer surface of the mandrel, the second container having an interior containing the chemical substance and wherein in step (e) the milling causes a rupture of the second container and a release of the chemical substance from the interior of the second container into the wellbore.

19. The method of claim 18, wherein the frac plug further comprises a third container operatively positioned about the outer surface of the mandrel, the third container having an interior containing the chemical substance and wherein in step (e) the milling causes a rupture of the third container and a release of the chemical substance from the interior of the third container into the wellbore.

* * * * *